US006345400B2

(12) United States Patent
Elliott et al.

(10) Patent No.: US 6,345,400 B2
(45) **Date of Patent: *Feb. 12, 2002**

(54) PORTABLE COT APPARATUS

(75) Inventors: Ronald C. Elliott, Monterey; Renee D. Farrington, Salinas; Teresa Martini, Carmel Valley; Kelly G. Crampton, Soquel, all of CA (US); Timothy F. Lynch, Quincy, MI (US)

(73) Assignee: Earlychildhood LLC, Monterey, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/299,859

(22) Filed: Apr. 26, 1999

(51) Int. Cl.[7] ..... A47C 17/64

(52) U.S. Cl. ..... 5/110; 5/112; 5/114; 5/8

(58) Field of Search ..... 5/8, 110, 112, 5/114, 620, 627

(56) References Cited

U.S. PATENT DOCUMENTS

| | | | | |
|---|---|---|---|---|
| 1,355,486 A | | 10/1920 | Longenecker | |
| 1,457,232 A | * | 5/1923 | Sheney | 5/114 |
| 2,226,606 A | * | 12/1940 | Giles | 5/114 |
| 2,567,619 A | | 9/1951 | Rosenfeld | 5/181 |
| 2,670,478 A | * | 3/1954 | Gilfillan | 5/114 |
| 2,678,787 A | | 5/1954 | Averill | 248/120 |
| 2,721,338 A | | 10/1955 | Resnick | 5/285 |
| 2,871,489 A | | 2/1959 | Emmert | 5/114 |
| 2,916,239 A | | 12/1959 | Stopps | 248/120 |
| 2,924,830 A | * | 2/1960 | De Long | 5/8 |
| 3,336,060 A | | 8/1967 | Bradford | 287/54 |
| 3,400,671 A | | 9/1968 | Erismann | 108/53 |
| 3,601,825 A | | 8/1971 | Moorhead et al. | 5/113 |
| 3,670,750 A | | 6/1972 | Johnston | 135/5.1 |
| 3,710,405 A | | 1/1973 | Watts | 5/201 |
| 3,757,360 A | | 9/1973 | Wescott | 5/113 |
| 3,765,040 A | | 10/1973 | Holstein | 5/334 |
| 3,828,992 A | | 8/1974 | Cerchione | 224/9 |
| 3,839,754 A | * | 10/1974 | Hooper | 5/98.2 |

(List continued on next page.)

FOREIGN PATENT DOCUMENTS

| | | | |
|---|---|---|---|
| AU | 210562 | 3/1956 | 25/9 |

*Primary Examiner*—Lynne H. Browne
*Assistant Examiner*—James M Hewitt
(74) *Attorney, Agent, or Firm*—Haverstock & Owens LLP

(57) ABSTRACT

A stackable, portable cot apparatus is easily assembled and disassembled preferably without the use of any tools. The portable cot apparatus preferably includes a flexible support, a plurality of support members, and a plurality of connectors. Alternatively, the portable cot apparatus also includes a plurality of extension legs. When assembled together, the plurality of support members and the plurality of connectors form a cot frame of the portable cot apparatus. Preferably, the flexible support is configured to support the weight of a user and includes three permanent fasteners and a detachable fastener. The permanent fasteners and the detachable fastener preferably and removably attach the flexible support to the cot frame of the portable cot apparatus. Preferably, the detachable fastener is selectively attachable both prior to and after the cot frame of the portable cot apparatus is already assembled. The detachable fastener is preferably a hook and loop fastener. The permanent fasteners are preferably selectively attachable to the plurality of connectors prior to assembling the cot frame of the portable cot apparatus. Once the cot frame, the permanent fasteners, and the detachable fastener are properly assembled, the flexible support is configured to support a user while utilizing the portable cot apparatus. Preferably, the plurality of connectors are configured to maintain the cot frame a predetermined distance above the ground such that the flexible support does not contact the ground while the user rests on the portable cot.

29 Claims, 4 Drawing Sheets

U.S. PATENT DOCUMENTS

| | | | | | |
|---|---|---|---|---|---|
| 3,846,855 | A | | 11/1974 | Peterson | 5/114 |
| 3,956,781 | A | | 5/1976 | Reemelin | 5/114 |
| 3,965,502 | A | | 6/1976 | Bertram | 5/111 |
| 4,034,518 | A | | 7/1977 | Trecker | 5/114 |
| 4,037,871 | A | | 7/1977 | Bourgraf et al. | 296/20 |
| 4,065,818 | A | | 1/1978 | Farina | 5/288 |
| 4,234,005 | A | | 11/1980 | Taylor, III | 135/1 |
| 4,234,978 | A | | 11/1980 | Snow | 5/111 |
| 4,571,760 | A | | 2/1986 | Kassai | 5/99 |
| 4,646,371 | A | | 3/1987 | Nowell | 5/200 |
| 4,663,787 | A | | 5/1987 | Kölsch | 5/110 |
| 4,685,160 | A | | 8/1987 | Rizzardo | 5/68 |
| 4,688,281 | A | | 8/1987 | Lantz | 5/111 |
| 4,729,136 | A | | 3/1988 | Santo | 5/201 |
| 4,767,148 | A | | 8/1988 | Ferneau et al. | 296/20 |
| 4,870,711 | A | | 10/1989 | Felix | 5/200 |
| 4,883,206 | A | | 11/1989 | Miller | 224/153 |
| 4,885,812 | A | | 12/1989 | Lindner | 5/113 |
| 4,926,513 | A | | 5/1990 | Oats | 5/488 |
| 4,958,390 | A | * | 9/1990 | Mendenhall | 5/110 |
| 5,003,649 | A | * | 4/1991 | Kelly | 5/8 |
| 5,023,968 | A | | 6/1991 | Diehl et al. | 5/82 |
| 5,109,556 | A | | 5/1992 | Cook | 5/110 |
| 5,121,514 | A | | 6/1992 | Rosane | 5/628 |
| 5,193,234 | A | | 3/1993 | Joaquin | 5/99.1 |
| 5,212,841 | A | | 5/1993 | Binnersley | 5/99.1 |
| 5,257,428 | A | * | 11/1993 | Carroll et al. | 5/620 |
| 5,265,289 | A | | 11/1993 | Swiger et al. | 5/111 |
| 5,301,377 | A | | 4/1994 | Kim | 5/110 |
| 5,303,438 | A | | 4/1994 | Walker | 5/652 |
| 5,432,966 | A | | 7/1995 | Berta et al. | 5/611 |
| 5,435,027 | A | | 7/1995 | Bourgraf et al. | 5/611 |
| 5,489,052 | A | | 2/1996 | Blood, Jr. | 224/156 |
| 5,490,292 | A | | 2/1996 | Auburn | 5/8 |
| 5,632,052 | A | | 5/1997 | Michel | 5/655 |
| 5,720,057 | A | | 2/1998 | Duncan | 5/420 |
| 6,092,769 | A | * | 7/2000 | Brown | 248/166 |

* cited by examiner

PORTABLE COT APPARATUS

FIELD OF THE INVENTION

The present invention relates to the field of cots. More particularly, this invention relates to cots that are both stackable and portable.

BACKGROUND OF THE INVENTION

Cots have many uses and have been well known for many years. Cots have widespread use in conjunction with such outdoor activities as mountain climbing, fishing, boating, hunting, camping, and the like. Further, such portable cots can be utilized as an extra bed in a home, napping area at a day care facility, and any location where a temporary sleeping/resting device is sometimes needed.

Some portable cots have hinged bars along the side of the portable bed and leg members hingedly affixed to the side rails. These portable cots are cumbersome to assemble and uncomfortable to utilize. Further, these portable cots are generally not stackable.

Other portable beds that are stackable generally require the use of tools during assembly and disassembly. One example of such a portable cot is shown in U.S. Pat. No. 4,958,390. The portable cot shown in U.S. Pat. No. 4,958, 390 requires the use of tools to either assemble or disassemble this portable cot. When completely assembled, this portable cot utilizes numerous screws to securely hold components of the portable cot together. A screw driver is therefore necessary in order to assemble or disassemble this portable cot.

Portable cots are also made from aluminum tubing. This aluminum tubing is light in weight and allows the portable cot to have legs which are hingedly attached. An example of such a portable bed is shown in U.S. Pat. No. 3,839,754. However, the portable cot described in U.S. Pat. No. 3,839, 754, can neither be disassembled nor stackable with other portable cots.

Many of these prior portable beds are either difficult to assemble, difficult to disassemble, and/or not stackable. What is needed is a portable bed apparatus which is easily assembled and disassembled without the use of tools. What is also needed is a portable bed apparatus that is easily stackable for storage.

SUMMARY OF THE INVENTION

A stackable, portable cot apparatus is easily assembled and disassembled preferably without the use of any tools. The portable cot apparatus preferably includes a flexible support, a plurality of support members, and a plurality of connectors. Alternatively, the portable cot apparatus also includes a plurality of extension legs. When assembled together, the plurality of support members and the plurality of connectors form a cot frame of the portable cot apparatus. Preferably, the flexible support is configured to support the weight of a user and includes three permanent fasteners and a detachable fastener. The permanent fasteners and the detachable fastener preferably and removably attach the flexible support to the cot frame of the portable cot apparatus. Preferably, the detachable fastener is selectively attachable both prior to and after the cot frame of the portable cot apparatus is already assembled. The detachable fastener is preferably a hook and loop fastener. The permanent fasteners are preferably selectively attachable to the plurality of connectors prior to assembling the cot frame of the portable cot apparatus. Once the cot frame, the permanent fasteners, and the detachable fastener are properly assembled, the flexible support is configured to support a user while utilizing the portable cot apparatus. Preferably, the plurality of connectors are configured to maintain the cot frame a predetermined distance above the ground such that the flexible support does not contact the ground while the user rests on the portable cot.

DETAILED DESCRIPTION OF THE INVENTION

Figure 1:
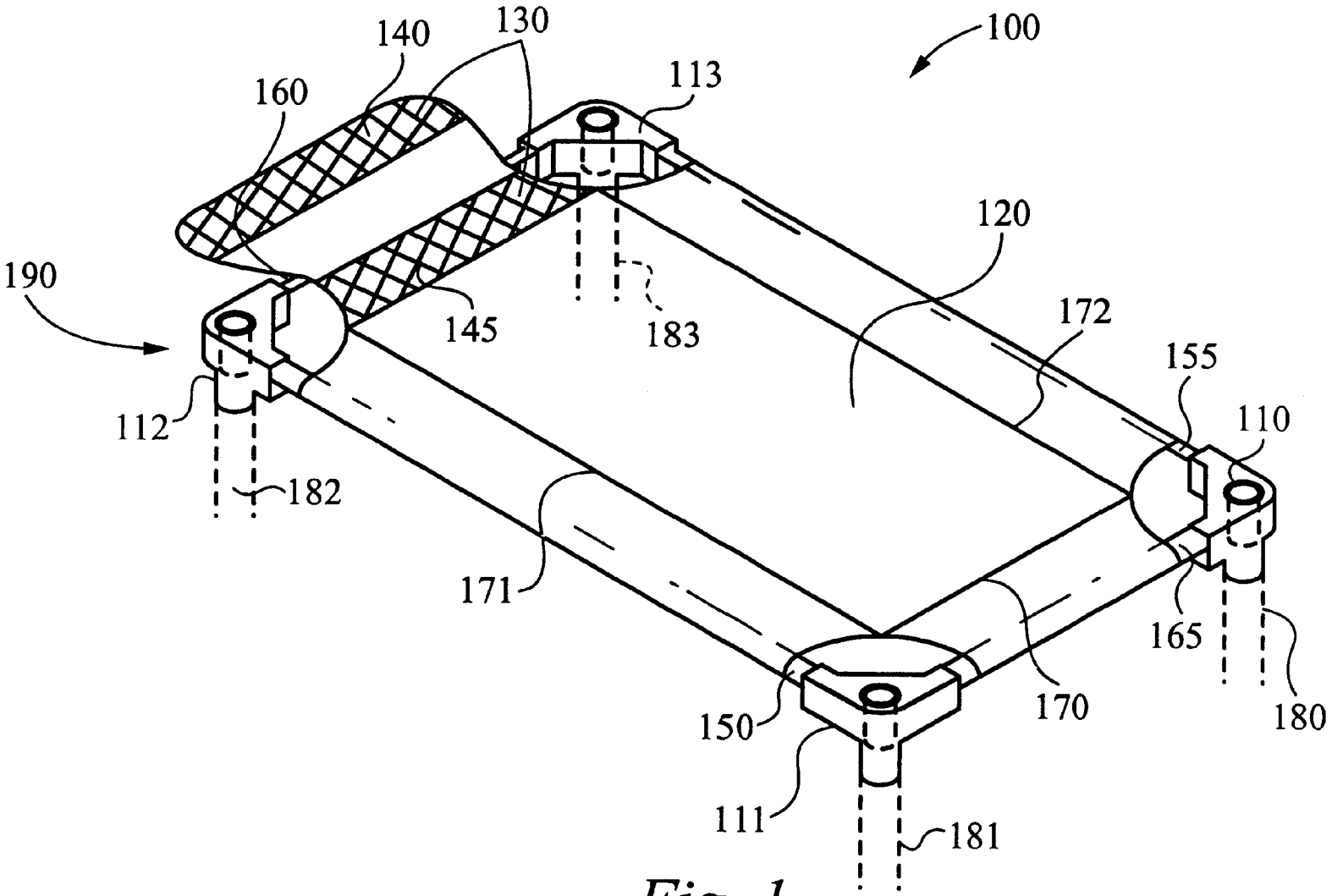
FIG. 1 illustrates a perspective view of a preferred embodiment of the present invention.

FIG. 1 illustrates a perspective view of the preferred embodiment of the present invention. The present invention is a portable cot apparatus 100 which preferably allows a user to conveniently assemble and disassemble the portable cot apparatus 100 without utilizing any tools. While assembled, the portable cot apparatus 100 provides the user with a comfortable place to rest and/or sleep. Further, while still assembled, the portable cot apparatus 100 is designed to allow multiple portable cot apparatuses 100 to stack within each other to save space when the cots are not being utilized. The portable cot apparatus 100 can be disassembled by separating its components, making the portable cot apparatus 100 easy to transport. Preferably, this disassembly is also performed without the use of any tools.

Figure 2:
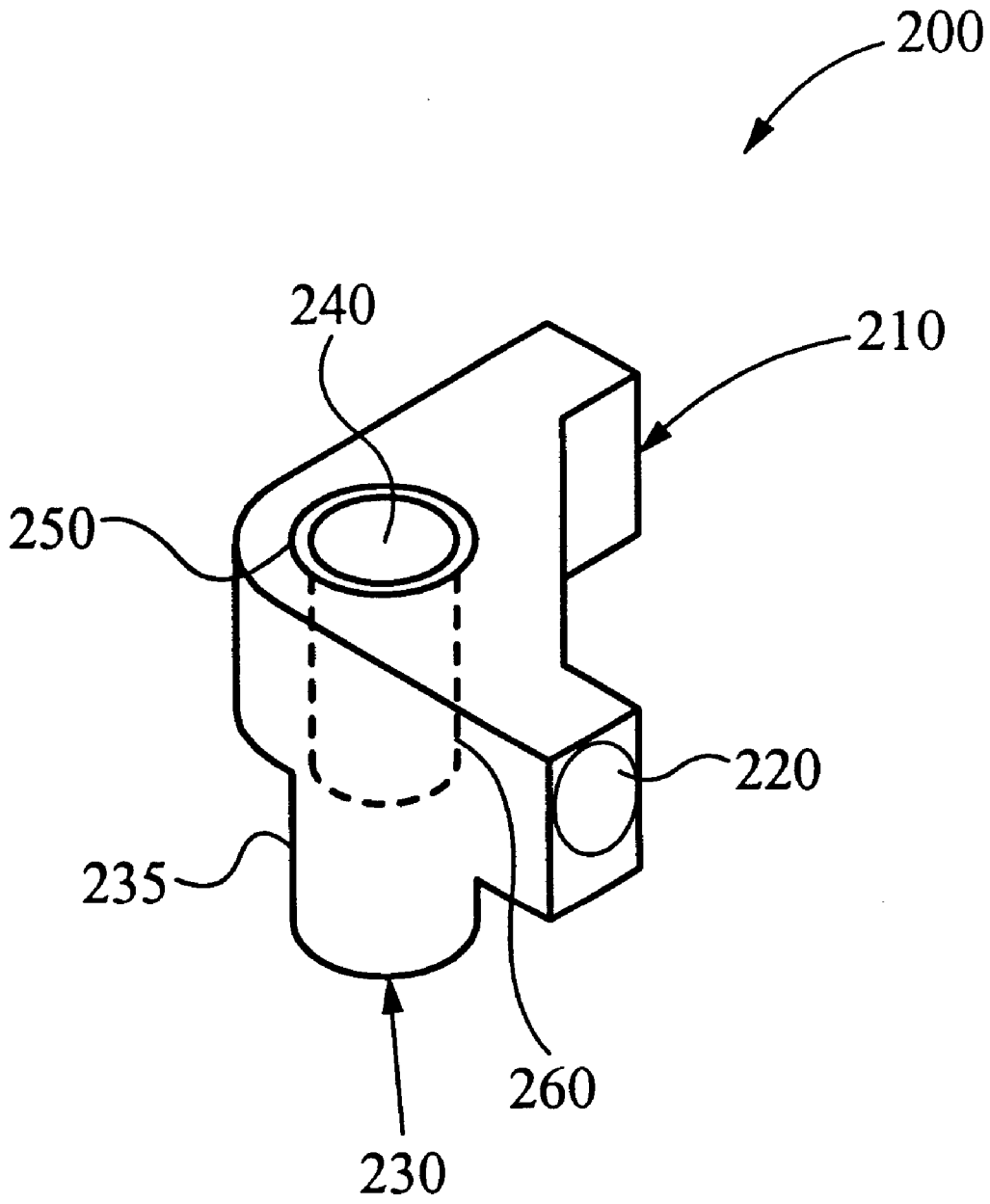
FIG. 2 illustrates a perspective view of a connector within the preferred embodiment of the present invention.

The portable cot apparatus 100 comprises a frame structure 190 and a flexible support 120. The frame structure includes corner connectors 110, 111, 112, and 113 and rail structures 150, 155, 160, and 165. A perspective view of a corner connector 200 is illustrated in FIG. 2. The corner connector 200 is representative of the corner connectors 110, 111, 112, and 113. The corner connector 200 preferably has four openings, including two horizontal frame openings 210 and 220 and two vertical support openings 230 and 240. The corner connector 200 also includes an integrated leg 235. Each of the horizontal frame openings 210 and 220 is preferably configured to accept an end of a rail structure such as the rail structures 150, 155, 160, and 165 (FIG. 1). The vertical support opening 240 is preferably configured to accept the integrated leg 235 of another corner connector of another cot when two or more cots are stacked together. The vertical support opening 230 extends through the integrated leg 235. Together, the vertical support openings 230 and 240 form a single vertical passage through the connector 200. Within an alternate embodiment, the vertical support opening 230 accepts an extension leg, such as the legs 180, 181, 182, and 183 (FIG. 1). These extension legs 180, 181, 182, and 183 are added to the frame structure 190 to raise the frame structure 190 to a predetermined height above the ground. This predetermined height is adjusted by varying the length of the extension legs 180, 181, 182, and 183.

Preferably, each of the horizontal frame openings 210 and 220 is also configured to securely and snugly hold an end of an appropriate rail structure without the use of any tools or the need for additional hardware such as clamps, screws, bolts, brackets, or the like. Both of the horizontal frame openings 210 and 220 are capable of securely holding any of the rail structures 150, 155, 160, and 165 when the appropriate rail structure is pushed into place within one of the openings 210 and 220 by the user. This process of pushing the appropriate rail structure into one of the openings 210 and 220 requires no tools. Additionally, the resulting connection between the one of the openings 210 and 220 and the end of the appropriate rail structure preferably remains firmly coupled and is referred to as "pressure fitted". Similar to the process of coupling, each of the openings 210 and 220 is also preferably configured to release the appropriate rail structure without any tools. Because the appropriate rail structure and one of the openings 210 and 220 are pressure fitted together, to disassemble a rail structure from a connector, the user pulls the appropriate rail structure away from the appropriate opening 210 or 220 to release the pressure holding the pieces together.

In the preferred embodiment illustrated in FIG. 1, the rail structure 150 is coupled between the corner connectors 111 and 112 to form a side of the frame structure 190. Additionally, the rail structure 155 is coupled between the corner connectors 110 and 113 to form a side of the frame structure 190. The rail structure 160 is preferably coupled between the corner connectors 112 and 113 to form an end of the frame structure 190. The rail structure 165 is preferably coupled between the corner connectors 110 and 111 to form an end of the frame structure 190. Each of the rail structures 150, 155, 160, and 165 are configured to removably couple with the appropriate corner connectors 110, 111, 112, and 113 to preferably form a cot frame 190. Preferably, the rail structures 150, 155, 160, and 165 and the corner connectors 110, 111, 112, and 113 hold the cot frame 190 together. Further, the cot frame 190 is also preferably held together, in part, by the flexible support 120 as discussed in detail below.

In an alternate embodiment, the cot frame 190 is raised above a ground level and rests on the extension legs 180, 181, 182, and 183. Each of these legs is inserted into and held within the vertical support opening 230 of the appropriate corner connector. For example, the extension leg 180 is coupled to the corner connector 110; the extension leg 181 is coupled to the corner connector 111; the extension leg 182 is coupled to the corner connector 112; and the extension leg 183 is coupled to the corner connector 113.

Preferably, the cot frame 190 is capable of being assembled and disassembled without any tools. The corner connectors 110, 111, 112, and 113 are preferably configured to retain an end of an appropriate rail structure through the pressure fitted connection. Also, preferably a sufficient length of the end of the rail structures are held within the horizontal openings of the connectors to provide sufficient rigidity and strength to the overall frame structure, without requiring the use of any additional securing devices, such as screws or bolts. Alternatively, a bolt, screw or other securing device is utilized to provide additional support to the combination of the horizontal opening and the end of the rail structure.

It will be apparent to those skilled in the art to utilize any number of support members, connectors, or legs to comprise the cot frame 190. Although not specifically stated, it will also be apparent to those skilled in the art to utilize any appropriate combination of dimensions for the rail structures and legs.

The flexible support 120 preferably comprises permanent fasteners 170, 171, and 172, and a detachable fastener 130. Each of the permanent fasteners 170, 171, and 172 are preferably configured to couple with the rail structures 165, 150, and 155, respectively. Preferably, the permanent fasteners 170, 171, and 172 are formed by wrapping a portion of the flexible support 120 over and onto itself and securing an edge of this portion back onto the flexible support 120 by heat sealing, thereby forming a sleeve. Alternatively, the edges of the flexible support 120 are also sealed by reinforced stitching. The permanent fasteners 170, 171, and 172, preferably have sufficient strength to remain coupled with their respective rail structure while supporting the weight of the user.

The detachable fastener 130 preferably comprises a loop fabric portion 140 and a hook fabric portion 145. Preferably, the loop fabric portion 140 and the hook fabric portion 145 are configured to removably and selectively couple with each other. As shown in FIG. 1, the loop fabric portion 140 is preferably attached to an edge portion of the flexible support 120. Further, the hook fabric portion 145 is shown attached to the flexible support 120. Both the loop fabric portion 140 and the hook fabric portion 145 are preferably attached to and positioned on the flexible support 120 such that the detachable fastener 130 is configured to selectively and securely couple to the rail structure 160 by wrapping around the rail structure and securing the hook fabric portion 145 to the loop fabric portion 140. Further, the detachable fastener 130 also preferably has sufficient strength to remain secured around the rail structure 160 while supporting the weight of the user. The flexible support 120 can be tightened or loosened, as appropriate, by adjusting the relationship of the hook fabric portion 145 to the loop fabric portion 140.

The preferred embodiment utilizes the detachable fastener 130 which includes the interlocking hook and loop fabric portions 145 and 140. In alternate embodiments, as should be apparent to those skilled in the art, different types of appropriate detachable fasteners such as zippers, snaps, quick-releases, and the like can be utilized in place of the interlocking hook and loop fabric found in the detachable fastener 130.

In alternate embodiments, any combination of the permanent fasteners 170, 171, and 172 can be substituted with a detachable fastener similar to the detachable fastener 130. Further, the detachable fastener 130 can also be substituted for a permanent fastener similar to the permanent fasteners 170, 171, and 172.

In the preferred embodiment, a receptacle 250 is located in close proximity to the vertical support opening 240 of the connector 200, as shown in FIG. 2. Preferably, the receptacle 250 is configured to retain an integrated leg 235 from a corner connector of a different portable cot. The receptacle 250 is preferably utilized to allow more than one portable cot apparatus 100 (FIG. 1) to neatly and securely stack within each other by inserting an appropriate integrated leg 235 of a corner connector of one portable cot apparatus within the receptacle 250 of another portable cot apparatus. Specific details of stacking and nesting are described in detail below and shown in FIGS. 3 and 4.

Figure 3:
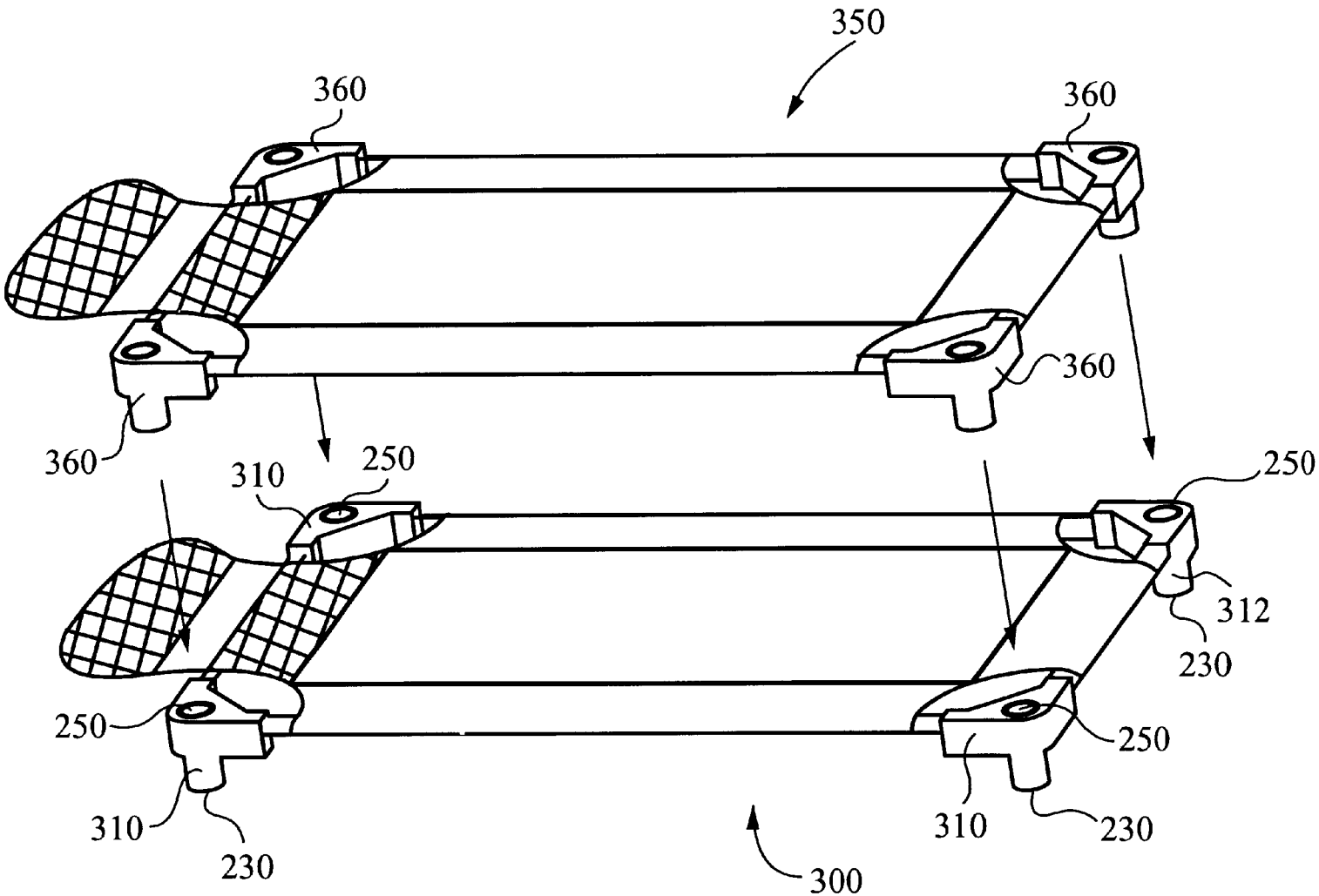
FIG. 3 illustrates two portable cots without legs configured to stack on top of each other.

FIG. 3 illustrates two portable cots without extension legs which are configured to securely stack together in a vertical stack to conserve space. Bottom and top portable cots 300 and 350 are similar to the portable cot apparatus 100 (FIG. 1) without the extension legs 180, 181, 182, and 183, as shown in FIG. 1. The bottom portable cot apparatus 300 is preferably configured to allow a top portable cot apparatus 350 to securely nest within the bottom portable cot apparatus 300. By nesting the top apparatus 350 within the bottom apparatus 300, the present invention allows two portable cots to be securely stored while conserving space. The bottom portable cot apparatus 300 includes a plurality of connectors 310 wherein each of the plurality of connectors 310 further includes the receptacle 250 including the vertical support opening 230. This receptacle 250 is also described above and illustrated in FIG. 2. Each vertical support opening 230 is preferably configured to securely hold a caster. By utilizing a caster at each vertical support opening 230, the bottom portable cot apparatus 300 in a stack is configured to be easily moved across the ground. Alternatively, any cot apparatus can include casters, as appropriate, at each vertical support opening 230, for easy relocation of the cot apparatus.

The top portable cot apparatus 350 preferably includes a plurality of connectors 360 wherein each of the plurality of connectors 360 further includes an integrated leg 235. The top apparatus 350 is configured to securely nest within the bottom apparatus 300 by resting each of the integrated legs 235 of the connectors 360 of the top apparatus 350 within a corresponding receptacle 250 of the bottom apparatus 300. Each of the receptacles 250 within the connectors 310 securely hold the integrated legs 235 of the connectors 360 to prevent the cot 350 from being knocked off or slipping from the portable cot 300.

Figure 4:
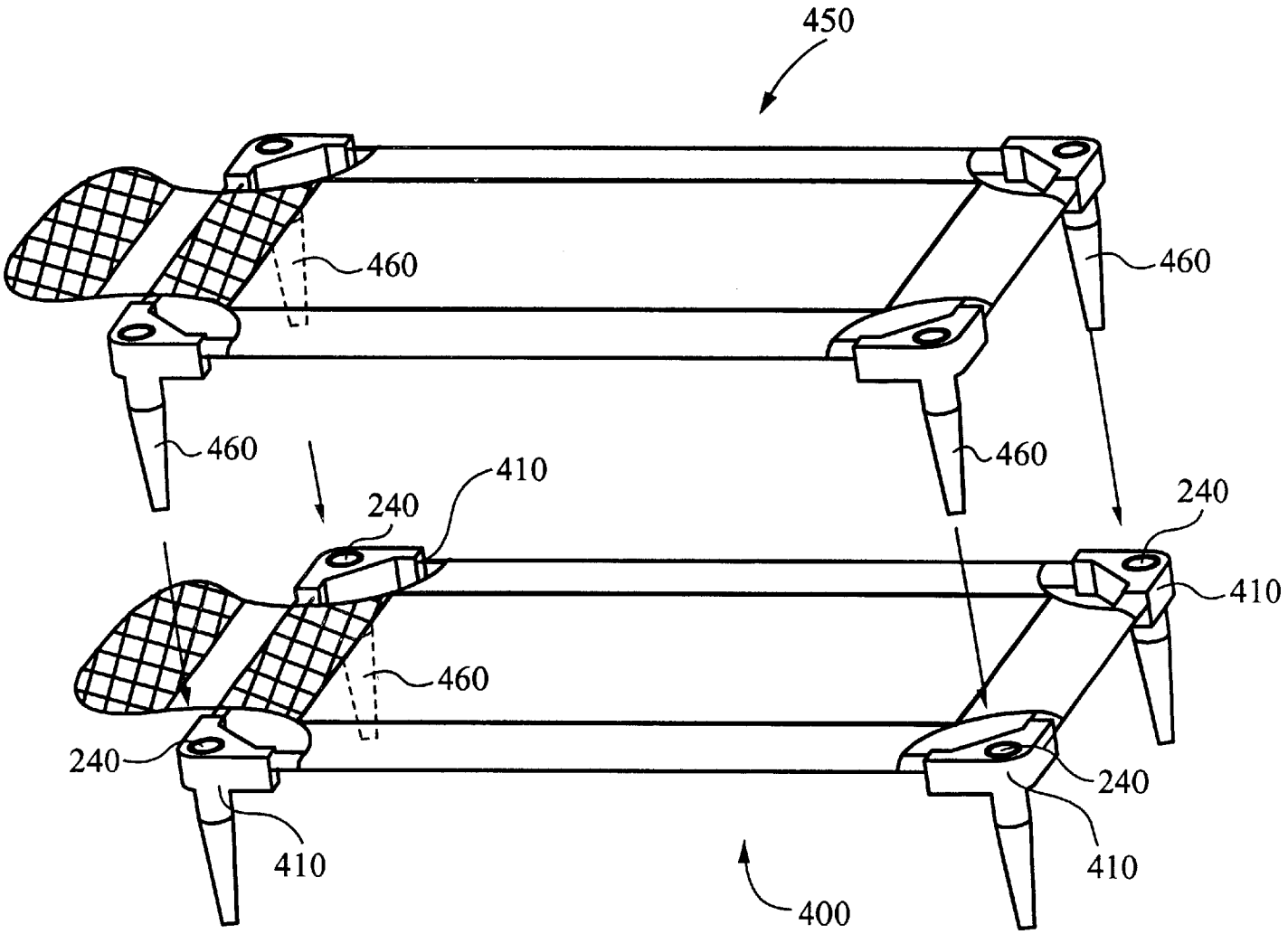
FIG. 4 illustrates two portable cots with legs configured to stack on top of each other.

FIG. 4 illustrates an alternate embodiment showing two portable cots including extension legs which are configured to securely stack together in such a manner to conserve space. Bottom and top portable cots 400 and 450 are similar to the portable cot apparatus 100 (FIG. 1). The bottom portable cot apparatus 400 is configured to allow a top portable cot apparatus 450 to securely nest within the bottom portable cot apparatus 400. By nesting the top apparatus 450 within the bottom apparatus 400, the present invention allows two portable cots to be securely stored while conserving space. The bottom portable cot apparatus 400 includes a plurality of corner connectors 410 wherein each of the plurality of corner connectors 410 further includes the vertical support opening 240. This vertical support opening 240 is also described above and illustrated in FIG. 2. The top portable apparatus 450 includes a plurality of legs 460. The top apparatus 450 is configured to securely nest within the bottom apparatus 400 by positioning each of the plurality of extension legs 460 of the top apparatus 450 within a corresponding vertical support opening 240 within the corner connectors 410 of the bottom portable cot apparatus 400.

To assemble the portable cot apparatus 100, the cot frame 190 (FIG. 1) is assembled with the flexible support 120. To begin this assembly, the rail structure 150 is preferably slipped through the permanent fastener 171. Next, the corner connectors 111 and 112 are appropriately coupled to the rail structure 150 by inserting each end of the rail structure into an appropriate horizontal support opening within the corner connectors 111 and 112 thereby forming a pressure fit between the end of the rail structure and the corresponding horizontal support opening. The rail structure 155 is then slipped through the permanent fastener 172, and the corner connectors 110 and 113 are appropriately coupled to the rail structure 155 by inserting each end of the rail structure into an appropriate horizontal support opening within the corner connectors 110 and 113 thereby forming a pressure fit between the end of the rail structure and the corresponding horizontal support opening.

The rail structure 165 is then slipped through the permanent fastener 170. Next, the rail structure 165 is appropriately coupled to the corner connectors 110 and 111 by inserting each end of the rail structure into an appropriate horizontal support opening within the corner connectors 110 and 111 thereby forming a pressure fit between the end of the rail structure and the corresponding horizontal support opening. The rail structure 160 is then coupled to the corner connectors 112 and 113 by inserting each end of the rail structure 160 into an appropriate horizontal support opening within the corner connectors 112 and 113 thereby forming a pressure fit between the end of the rail structure and the corresponding horizontal support opening.

To complete the assembly of the cot frame 190, the detachable fastener 130 is wrapped around the rail structure 160 and secured by attaching the loop fabric portion 140 to the hook fabric portion 145. In an alternate embodiment, the extension legs 180, 181, 182, and 183 are coupled to the corner connectors 110, 111, 112, and 113, respectively.

As described above, the assembly of the portable cot apparatus 100 is preferably performed without the use of tools. Complete disassembly of the portable cot apparatus 100 is a convenient, simple process that is also preferably accomplished without any tools. To disassemble the portable cot apparatus 100, a user reverses the steps outlined above to assemble the portable cot apparatus 100, by separating the corner connectors 110, 111, 112 and 113 from the rail structures 150, 155, 160 and 165.

In order to remove the flexible support 120, disassembling the entire portable cot 100 is unnecessary. The corner connectors 110 and 111 must be disconnected from the rail structures 150, 155, and 165 in order to separate the flexible support 120 from the frame structure 190. Because connections between each rail structure and corresponding corner connectors are formed by a pressure fit, these connections are disconnected without the use of tools. By disconnecting the corner connectors 110 and 111 from the rail structures 150, 155, and 165, the permanent fastener 170 is removed from the rail structure 165. The detachable fastener 130 is disengaged from the rail structure 160 by pulling the loop fabric portion 140 and the hook fabric portion 145 away from each other. The flexible support 120 is then removed from the portable cot 100 by sliding the flexible support 120 such that the permanent fasteners 171 and 172 are disconnected from the rail structures 150 and 155, respectively.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

Specifically, it will be apparent to one of ordinary skill in the art that the device of the present invention could be implemented in several different ways and the embodiments disclosed above are only exemplary of the preferred embodiment and the alternate embodiments of the invention and is in no way a limitation. In particular, the detachable fastener utilizing hook and loop fabric can be substituted by other detachable fasteners such as zippers, snaps, quick-releases, and the like.

We claim:

1. A portable cot apparatus comprising:

a. a stackable frame structure including a plurality of rail structures for supporting the portable cot apparatus; and b. a flexible support having a detachable fastener for removably and selectively coupling the flexible support to the stackable frame structure, the detachable fastener having fastener portions attached along an edge of the flexible support such that the flexible support is removably and selectively coupled to the stackable frame structure by wrapping the flexible support around at least one of the plurality of rail structures and interlocking the fastener portions to form a sleeve around the at least one rail structure wherein the at least one rail structure is substantially covered with the sleeve.

2. The portable cot apparatus of claim 1, wherein the detachable fastener comprises at least one piece of hook fabric and one piece of loop fabric.

3. The portable cot apparatus of claim 1, wherein the stackable frame structure further comprises four connectors with horizontal openings for receiving ends of the rail structures and for detachably interconnecting the plurality of rail structures into a rectangular frame.

4. The portable cot apparatus of claim 3, wherein each of the connectors further comprises an integrated support leg.

5. The portable cot apparatus of claim 4, wherein each of the connectors further comprises a top vertical opening for receiving an integrated leg of a second portable cot apparatus for stacking the second portable cot apparatus on the connectors.

6. The portable cot apparatus of claim 5, wherein each of the connectors further comprises a bottom vertical opening configured to receive a support attachment.

7. The portable cot apparatus of clam 6, wherein the bottom vertical opening is configured for receiving a support attachment selected from the group consisting of an extension leg and a caster.

8. The portable cot apparatus of claim 1, wherein the flexible support further comprises two sleeves on two opposite edges of the flexible support, wherein rail structures forming opposite sides of the stackable frame are capable of being slidably positioned through the two sleeves.

9. A portable cot apparatus comprising:

a. four rail structures;

b. four corner connectors configured for removably coupling to the four rail structures to form a rectangular frame; and c. a flexible support removably coupled to each side of the rectangular frame wherein the flexible support is removably coupled to at least one side of the rectangular frame structure by a detachable fastener including interlocking fastener portions attached to the flexible support, wherein the detachable fastener is configured for forming a sleeve around the at least one side of the rectangular frame by wrapping a portion of the detachable fastener around the at least one side of the rectangular frame and securing the interlock fastener portions.

10. The portable cot apparatus of claim 9, wherein the flexible support is coupled to three sides of the rectangular frame structure through permanent sleeves on edges of the flexible support wherein the rail structures forming three corresponding sides of the rectangular frame are slidably positioned within the permanent sleeves.

11. The portable cot apparatus of claim 9, wherein each of the four corner connectors further comprises an integrated leg for supporting the portable cot apparatus on a surface.

12. The portable cot apparatus of claim 11, wherein each of the four corner connectors further comprises a top vertical opening for receiving an integrated leg of a second portable cot apparatus such that the second portable cot apparatus is capable of being securely stacked and nested within the vertical openings.

13. The portable cot apparatus of clam 9, further comprising extension legs coupled to each of the four corner connectors.

14. The portable cot apparatus of claim 9, wherein the flexible support is made of fabric material.

15. A portable cot apparatus of claim 9, wherein the interlocking fastener portions comprise a piece of loop fabric and a piece of hook fabric.

16. A portable cot apparatus comprising:

a. a rectangular frame including a first rail section that is configured to be detachably coupled to a second and a third rail section, wherein the second and the third rail sections are configured to be detachably coupled to a fourth rail section; and b. a rectangular support configured to be detachably coupled to each of the first, second, third and fourth rail sections, the rectangular support including a first sleeve along a first edge for detachably coupling to the first rail section, a second sleeve along a second edge for detachably coupling to the second rail section, a third sleeve along a third edge for detachably coupling to the third rail section and a detachable fastener along a fourth edge for detachably coupling to the fourth rail section the detachable fastener comprises a two part fastener attached to the flexible support, wherein the rectangular support is secured to the fourth rail structure by wrapping a portion of the detachable fastener around the fourth rail section and securing the two part fastener to form a detachable sleeve and, wherein, the rectangular support is removed from the rectangular frame by detaching the first rail section from the second and third rail sections, unfastening the detachable fastener from the fourth rail section and sliding the second and third sleeves off of the second and third rail sections.

17. The portable cot apparatus of claim 16, wherein the first rail section is configured to be detachably coupled to the second and the third rail section through corner connectors and wherein the second and the third rail sections are configured to be detachably coupled to the fourth rail section through corner connectors, wherein each of the corner connectors have holes for receiving ends of the each rail section.

18. The portable cot apparatus of claim 16, wherein the rectangular frame is configured to interlock with a second rectangular cot frame such that the second cot frame is capable of being securely stacked and nested therein.

19. The portable cot apparatus of claim 16, further comprising a plurality of extension legs coupled to the frame and configured to maintain the portable cot apparatus at a predetermined height.

20. The portable cot apparatus of claim 16, wherein the flexible support comprises a fabric material.

21. The portable cot apparatus of claim 16, wherein the two part fastener comprises hook fabric and loop fabric.

22. A stacking cot system comprising;

a a plurality of portable cots wherein each cot comprises:

a. a stackable frame comprising;

i. four rail sections; and ii. four connectors for connecting the four rail sections, wherein each of the four connectors has a top opening for receiving a connector of a next stacked cot and a bottom vertical opening for receiving an extension leg; and b. a flexible support having a detachable fastener for removably and selectively coupling the flexible support to the stackable frame, the detachable fastener having fastener portions attached along an edge of the flexible support such that the flexible support is removably and selectively coupled to the stackable frame by wrapping the flexible support around at least one of the four of rail sections and interlocking the fastener portions to form a sleeve around the at least one of the four rail sections wherein the at least one of the four rail sections is substantially covered by the sleeve.

23. The stacking cot system of claim 22, wherein the flexible support further comprises two sleeves on two opposite edges of the flexible support, wherein two of the four rail sections forming opposite sides of the stackable frame are capable of being slidably positioned through the two sleeves on the two opposite edges of the flexible support.

24. The stacking cot system of claim 22, wherein a least one of the plurality of cots is configured with casters through which the plurality of portable cots is moveably supported.

25. A cot comprising;

a. a rectangular frame comprising a first and a second side rail section and a first and a second end rail section configured to couple through four corner connectors to form the rectangle frame; and b. a rectangular cover section configured to couple to the rectangular frame through the first and the second side rail section and the first and the second end rail section, the rectangular cover section comprising a first and a second side sleeve structure and a first and a second end sleeve structure, each sleeve structure being configured for receiving a corresponding rail structure, wherein the first end sleeve structure is formed by folding a portion of the cover section over onto itself and engaging a two part connector coupled to the portion of the cover section, whereby the cot is capable of being assembled by the following steps of;

i. connecting one end of each of first and the second side rail sections to an end of the first end rail section through two of the four connectors to form a partial frame having two free ends;

ii. placing the two side sleeve structures over the first and the second side rail section of the partial frame;

iii. forming the first sleeve structure around the first end rail section;

iv. placing the second end sleeve structure over the second end rail section; and v. connecting each of the two free ends to an end of the second end rail section through the two remaining connectors.

26. The cot of claim 25, wherein the first side sleeve structure, the second side sleeve structure and the second end sleeve structure are permanent sleeve structures, whereby the steps of ii) placing the two side sleeve structures over the first and the second side rail section and iv) placing the second end sleeve structure over the second end rail section are accomplished by sliding the first side sleeve structure, the second side sleeve structure and the second end structure over the corresponding first side rail section, second side rail section and second end rail section.

27. The cot of claim 25, wherein the four connectors are configured to interlock with a second frame such that the second frame is capable of being securely stacked.

28. The cot of claim 27, wherein each of the four connectors is configured to receive a caster.

29. The cot of claim 27, wherein each of the four connectors is configured to receive an extension leg.

* * * * *

US006345400C1

(12) EX PARTE REEXAMINATION CERTIFICATE (8326th)

United States Patent
Elliott et al.

(10) Number: US 6,345,400 C1
(45) Certificate Issued: Jun. 14, 2011

(54) PORTABLE COT APPARATUS

(75) Inventors: Ronald C. Elliott, Monterey, CA (US); Renee D. Farrington, Salinas, CA (US); Teresa Martini, Carmel Valley, CA (US); Kelly G. Crampton, Soquel, CA (US); Timothy F. Lynch, Quincy, MI (US)

(73) Assignee: Bank of Montreal, Chicago, IL (US)

Reexamination Request:
No. 90/009,156, May 20, 2008

Reexamination Certificate for:

| | |
|---|---|
| Patent No.: | **6,345,400** |
| Issued: | **Feb. 12, 2002** |
| Appl. No.: | **09/299,859** |
| Filed: | **Apr. 26, 1999** |

(51) Int. Cl.
*A47C 17/64* (2006.01)

(52) U.S. Cl. ..... 5/110; 5/112; 5/114; 5/8
(58) Field of Classification Search ..... None
See application file for complete search history.

(56) References Cited

U.S. PATENT DOCUMENTS

| | | | |
|---|---|---|---|
| 2,670,478 | A | 3/1954 | Gilfillan |
| 4,883,206 | A | 11/1989 | Miller |
| 4,958,390 | A | 9/1990 | Mendenhall |
| 5,003,649 | A | 4/1991 | Kelly |
| 5,072,694 | A | 12/1991 | Haynes et al. |
| 6,345,400 | B2 | 2/2002 | Elliott et al. |

OTHER PUBLICATIONS

Mahar Manufacturing, Cot Assembly Instructions, 1997.
Mahar Manufacturing, 1998 Catalog, Cover and pp. 1, 2, 3, Dec. 1997, Jan. 1998.

*Primary Examiner*—Cary E. Wehner

(57) ABSTRACT

A stackable, portable cot apparatus is easily assembled and disassembled preferably without the use of any tools. The portable cot apparatus preferably includes a flexible support, a plurality of support members, and a plurality of connectors. Alternatively, the portable cot apparatus also includes a plurality of extension legs. When assembled together, the plurality of support members and the plurality of connectors form a cot frame of the portable cot apparatus. Preferably, the flexible support is configured to support the weight of a user and includes three permanent fasteners and a detachable fastener. The permanent fasteners and the detachable fastener preferably and removably attach the flexible support to the cot frame of the portable cot apparatus. Preferably, the detachable fastener is selectively attachable both prior to and after the cot frame of the portable cot apparatus is already assembled. The detachable fastener is preferably a hook and loop fastener. The permanent fasteners are preferably selectively attachable to the plurality of connectors prior to assembling the cot frame of the portable cot apparatus. Once the cot frame, the permanent fasteners, and the detachable fastener are properly assembled, the flexible support is configured to support a user while utilizing the portable cot apparatus. Preferably, the plurality of connectors are configured to maintain the cot frame a predetermined distance above the ground such that the flexible support does not contact the ground while the user rests on the portable cot.

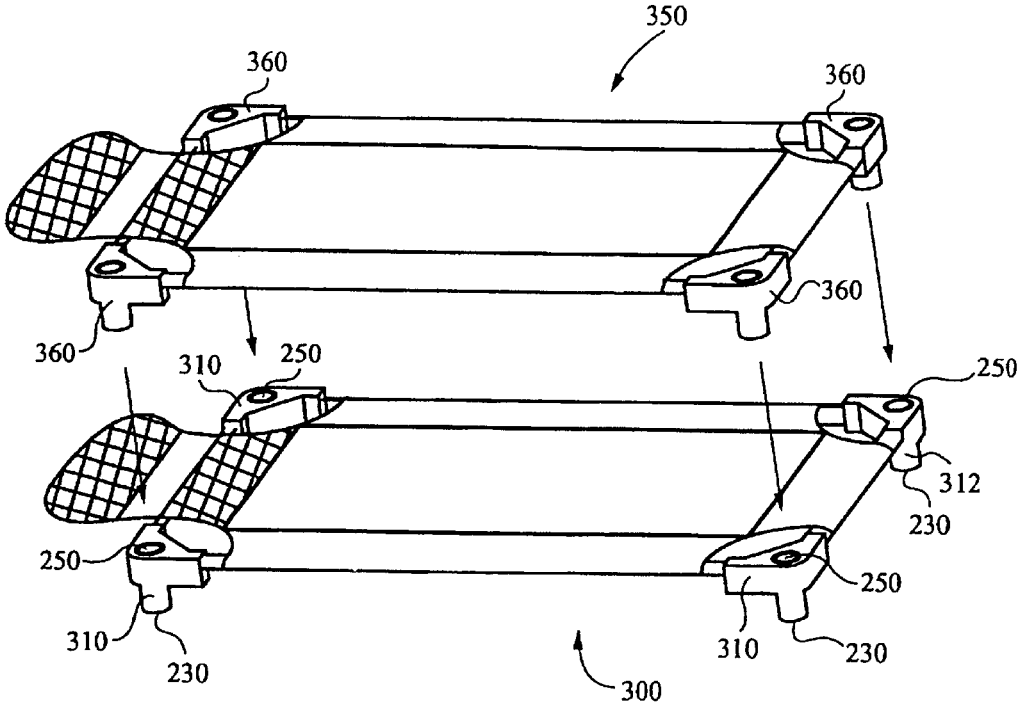

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-29 are cancelled.

* * * * *